US011939753B2

(12) United States Patent
Wölfler et al.

(10) Patent No.: US 11,939,753 B2
(45) Date of Patent: Mar. 26, 2024

(54) SINK WITH LIFTING DEVICE WHICH EXTENDS THROUGH THE BASE WALL OF THE BASIN FOR AN INSERT PLATE

(71) Applicant: BSH Hausgeräte GmbH, Munich (DE)

(72) Inventors: Andreas Wölfler, Saalfelden (AT); Benjamin Reu, Prien am Chiemsee (DE); Ingo Abels, Siegsdorf (DE); Brigitte Meyer, Chieming (DE)

(73) Assignee: BSH Hausgeräte GmbH, Munich (DE)

( * ) Notice: Subject to any disclaimer, the term of this patent is extended or adjusted under 35 U.S.C. 154(b) by 83 days.

(21) Appl. No.: 17/776,671

(22) PCT Filed: Nov. 11, 2020

(86) PCT No.: PCT/EP2020/081738
§ 371 (c)(1),
(2) Date: May 13, 2022

(87) PCT Pub. No.: WO2021/104872
PCT Pub. Date: Jun. 3, 2021

(65) Prior Publication Data

US 2022/0396940 A1 Dec. 15, 2022

(30) Foreign Application Priority Data

Nov. 29, 2019 (DE) ..... 102019218645.9

(51) Int. Cl.
*E03C 1/186* (2019.01)

(52) U.S. Cl.
CPC ..... *E03C 1/186* (2013.01)

(58) Field of Classification Search
CPC ..... E03C 1/186; A47L 17/02; A47L 19/02; A47L 19/04
See application file for complete search history.

(56) References Cited

U.S. PATENT DOCUMENTS 3,346,886 A * 10/1967 Kashiwamura ..... E03C 1/186 108/134
3,882,553 A 5/1975 Poiencot
2005/0067747 A1 3/2005 Erickson

FOREIGN PATENT DOCUMENTS

CN 105645301 A 6/2016
CN 105783392 A 7/2016
CN 106724144 A * 5/2017
CN 108316413 A * 7/2018
CN 108316413 A 7/2018
(Continued)

OTHER PUBLICATIONS

National Search Report DE 10 2019 218 645.9 dated Aug. 21, 2020.
International Search Report PCT/EP2020/081738 dated Jan. 29, 2021.

*Primary Examiner* — Erin Deery
(74) *Attorney, Agent, or Firm* — Michael E. Tschupp; Andre Pallapies; Brandon G. Braun

(57) ABSTRACT

A sink includes a basin including a base wall and lateral walls adjoining the base wall, with the basin including a receiving area delimited by the base wall and the lateral walls. An insert plate separate from the basin is inserted into the receiving area and moveable by a lifting device relative to the basin. The lifting device extends into the base wall through an opening such that the lifting device is arranged on both sides of the base wall. A securing device secures the lifting device to the base wall.

18 Claims, 4 Drawing Sheets

(56) References Cited

FOREIGN PATENT DOCUMENTS

| | | | | |
|---|---|---|---|---|
| CN | 108915045 | A | * | 11/2018 |
| DE | 3621151 | A1 | | 1/1988 |

* cited by examiner

SINK WITH LIFTING DEVICE WHICH EXTENDS THROUGH THE BASE WALL OF THE BASIN FOR AN INSERT PLATE

CROSS-REFERENCES TO RELATED APPLICATIONS

This application is the U.S. National Stage of International Application No. PCT/EP2020/081738, filed Nov. 11, 2020, which designated the United States and has been published as International Publication No. WO 2021/104872 A1 and which claims the priority of German Patent Application, Serial No. 10 2019 218 645.9, filed Nov. 29, 2019, pursuant to 35 U.S.C. 119(a)-(d).

The contents of International Application No. PCT/EP2020/081738 and German Patent Application, Serial No. 10 2019 218 645.9 are incorporated herein by reference in their entireties as if fully set forth herein.

BACKGROUND OF THE INVENTION

One aspect of the invention relates to a sink with a basin. The basin has a base wall and lateral walls adjoining the base wall. The basin has a receiving area delimited by the walls. Moreover, the sink has an insert plate which is separate from the basin and which is inserted into the receiving area.

Such sinks are known. Thus a sink which has a basin is disclosed, for example, in US 2005/0067747 A1. A base which is configured in one piece with the basin bottom and which extends upwardly is configured on the basin bottom. A plate may be attached to this base. As a result, a cutting board is formed on which objects, such as food, may be chopped. Such an embodiment is disadvantageous in that the integrated base is always present and thus a basic embodiment of the basin is complex in terms of shape and is configured such that the receiving area is restricted over the periphery. Moreover, it is always the case that the plate which is able to be positioned on the base is arranged only at one height level. The plate is only able to be positioned or removed by a user.

A sink is also disclosed in DE 362 1151 A1. Various inserts which may be inserted into the receiving area are provided separately from the basin. The inserts may be plates or further basin-like containers. These inserts may be positioned on the upper edge of the basin. The usability of a sink is also significantly restricted thereby and the inserts have to be attached or removed by a user, and it is always the case that the inserts are able to be positioned only at one individual position.

BRIEF SUMMARY OF THE INVENTION

It is the object of the present invention to provide a sink with a basin and a separate insert plate in which a lifting device for the insert plate is secured in a stable manner.

This object is achieved by a sink as claimed in claim 1.

One aspect of the invention relates to a sink with a basin. The basin has a base wall and lateral walls adjoining the base wall. The basin also has a receiving area delimited by the base wall and the lateral walls. The receiving area is open at the top. The sink has an insert unit, in particular an insert plate, in particular a contiguous and non-perforated insert plate, which is separate from the basin. This insert plate is able to be inserted into the receiving area or is inserted therein. The sink also has a lifting device, by means of which the insert plate can be moved relative to the basin in the height direction of the sink. This is made possible by a physical lifting device of the sink. Thus a sink is provided in which in principle the possibility is provided to arrange the insert unit at different vertical positions. This is also made possible by a lifting device and does not have to be carried out manually by the user himself. In principle, it is possible that a continuous vertical adjustment of the insert plate is made possible by the lifting device. Thus it is possible to approach and set many different height levels of the insert plate.

The lifting device is secured to the base wall of the basin by means of a securing device. The lifting device extends into the base wall through an opening or a leadthrough such that the lifting device is arranged on both sides of the base wall. By means of such an embodiment, the lifting device may be secured in a mechanically stable manner. In this context the base wall represents an advantageous mechanical coupling component of the basin. On the one hand, therefore, the lifting device may also be positioned and/or suspended directly on the base wall. In this context the base wall is a corresponding mechanically stable component. On the other hand, a space-saving design is provided by means of this embodiment, in which the lifting device also extends through an opening in the base wall and is configured on both sides of the opening. This is because, on the one hand, the lifting device is able to be accessed outside the receiving area. Thus the lifting device is able to be accessed outside the basin. On the other hand, it is also made possible by this embodiment that the entire lifting device does not have to be installed in the receiving area. As a result, the receiving area may be configured to be maximized and thus not undesirably restricted. In particular, by means of this embodiment of the lifting device it is also possible for the insert plate to be able to be lowered to a maximum degree downwardly toward the base wall.

In an advantageous embodiment it is provided that the lifting device has a lifting unit which is longitudinally adjustable in the height direction of the sink. As a result, the adjustment of the vertical position of the insert plate is advantageously possible. In particular, it is provided that this lifting unit is arranged centrally on the base wall. By means of such a central positioning, the insert plate arranged thereon is also held centrally in the middle. A particularly uniform movement of the insert plate upwardly and downwardly is made possible thereby, while maintaining the horizontal position of the insert plate. By the central positioning of the lifting unit on the base wall, the accessibility to the lifting unit in the receiving area itself is also made possible in many different ways and from all sides. In particular, the lifting device has only a single such lifting unit. As a result, the lifting unit is configured in a manner which reduces the number of components and the space requirement of the lifting device in the receiving area itself is minimized.

Preferably, it is provided that the lifting device has at least one separate damper unit, by means of which the lifting device is acoustically decoupled from the base wall. This is a further advantageous embodiment since noises, which are produced when lifting and lowering the insert plate in the height direction, may be damped. In particular, a transmission of these noises to the basin may be significantly reduced thereby. In particular, noises of a motor of the lifting unit, by means of which the height direction of a lifting apparatus of the lifting unit is changed, may also be at least significantly reduced thereby in order to be able to lift or lower the insert plate.

It may be provided that the damper unit is a rubber damper. The damper unit may also be an acoustic foam.

These embodiments permit, on the one hand, a compact construction of the damper unit with highly efficient acoustic decoupling. Moreover, such embodiments may additionally be used as different components. For example, coupling elements may be used for securing other components. For example, in this context an adapter which is arranged in the receiving area on the base wall may be connected to this damper unit. For example, one or more screw connections may be provided here.

In an advantageous embodiment it is provided that the damper unit bears directly against a lower face or against an outer face of the base wall. It may be provided that the damper unit is connected to a receiving housing of the lifting device which is arranged outside the receiving area and below the base wall. An efficient acoustic decoupling of the separate receiving housing from the base wall is also made possible thereby. Noises which occur in the receiving housing, for example motor noises, may be efficiently damped thereby.

It may be provided that the receiving housing is secured by a plurality of securing elements to the lower face of the base wall. This is a further very advantageous embodiment. This is because a simple suspension of the receiving housing on the lower face of the base wall is made possible thereby. A simple mounting scenario is achieved thereby since the receiving housing may be secured to the basin in a simple manner from outside the receiving space.

Preferably, it is provided that a securing element is configured with a plate-like base. In particular, the securing element is adhesively bonded or welded to this plate-like base, in particular directly on the lower face of the base wall. As a result, an advantageous connection which cannot be released in a non-destructive manner is formed between the securing element and the base wall. This securing is also mechanically highly stable. As a result, correspondingly large retaining forces may be achieved. In particular, this is advantageous in this regard when the receiving housing is secured or suspended from below on the base wall. Since this base is of plate-like configuration, a contact surface which is as large as possible is produced between the securing element and the lower face of the base wall. As a result, the securing element is also arranged over a surface area which is as large as possible on this lower face of the base wall, such that it cannot be released in a non-destructive manner. High retaining forces are possible as a result.

Preferably, it is provided that a securing element has a coupling pin. In particular, the receiving housing is arranged directly on this coupling pin. In particular, the receiving housing is suspended on this coupling pin. In this context, the receiving housing has coupling flanges. These coupling flanges preferably have leadthroughs. Coupling pins of securing elements are passed through these leadthroughs. As a result, the suspension of the receiving housing to the securing elements is, on the one hand, very stable and, on the other hand, very simple to mount. A rapid mounting concept is achieved thereby.

In a particularly advantageous embodiment it is provided that the coupling pin is configured as a vertical level regulation element. Thus the coupling pin is not only configured for the basic holding and securing of the receiving housing thereto. Rather it also represents a further functionality. By means of the embodiment as a vertical level regulation element the level of the receiving housing is able to be set in a defined manner in the height direction of the sink. This is advantageous since this receiving housing may be moved into a horizontal position in a particularly advantageous and simple manner. This is advantageous since therefore the lifting unit, in particular the lifting apparatus, may also be oriented horizontally. This has the advantage that with a movement of the lifting apparatus in the height direction, and thus when moved apart or moved together, it is always the case that an approximately vertical movement or only a fully vertical movement is able to be performed. This in turn leads to the insert plate being able to be moved upwardly and downwardly with such an accurate vertical movement. This level regulation element is also advantageous when the base wall, which is configured in particular from sheet metal or stainless steel, undergoes a deformation such that a receiving housing, which is not able to be regulated in terms of the level thereof, would then optionally also be moved out of the horizontal position. Thus such deformations of the base wall may be compensated by this possibility for the level regulation of the receiving housing via these multifunctionally designed coupling pins.

In particular, it is provided that the lifting device has a level compensation unit, by means of which a horizontal position of the insert plate and/or a fully vertical lifting movement of a lifting unit may be set.

It may be provided that the coupling pin has a thread for the level regulation. This is a very simple mechanical embodiment of a level regulation element. Thus it is possible for this level regulation to be able to be performed in the vertical position by means of counter elements, for example a screw nut which is screwed onto the thread.

It may also be provided that this level regulation element operates dynamically. Thus in embodiments in which the fully horizontal position of the receiving vessel changes, it is possible to react automatically and independently thereto and in turn the horizontal position of the receiving housing may be set. Preferably, at least one sensor is provided in such an electronic and/or hydraulic level regulation unit. This sensor is provided to detect the horizontal position of the receiving vessel. If in this context the fully horizontal position of the receiving vessel is no longer provided, this is detected by the sensor. The level regulation element may be activated by means of a control unit which evaluates the information of the sensor and which is constituent part of the sink. As a result, the horizontal position of the receiving housing is then set. For example, corresponding electromechanical and/or hydraulic and/or pneumatic adjusting members may be provided here.

In an advantageous embodiment it is provided that the lifting device has a lifting unit which is longitudinally adjustable in the height direction of the sink. The lifting unit has a housing. Moreover, the lifting unit has a lifting apparatus which is arranged in the housing. The lifting unit extends through the opening in the base wall of the basin. In particular, the lifting unit is arranged on both sides of the base wall. Thus in the mounted state both the housing of the lifting unit and the lifting apparatus extend on both sides of this opening of the base wall. The advantages which are achievable relative thereto have already been mentioned above relative to the corresponding embodiment of the entire lifting device.

In an advantageous embodiment it is provided that the housing of the lifting unit has a plurality of, in particular dimensionally rigid, housing segments. These housing segments are movable relative to one another in the height direction of the sink. In particular these housing segments form a telescopic housing of the lifting unit.

In an advantageous embodiment it is provided that the securing device has a multi-point bearing. In particular, a four-point bearing is configured. To this end, the securing device has, in particular, four separate securing elements. As a result, on the one hand, a particularly stable securing of the lifting device, in particular of a receiving housing of the lifting device, in particular on the base wall, is made possible. On the other hand, in an advantageous embodiment a particularly accurate level regulation setting of the receiving housing may be possible relative to the exact horizontal position.

Preferably, the lifting device has a receiving housing. This receiving housing is arranged below the base wall and thus outside the receiving area. A motor of the lifting device is arranged in the receiving housing. This motor is configured for driving a lifting unit of the lifting device.

In an advantageous embodiment it is provided that an upper face of the insert plate has a surface which is at least 80 percent, in particular at least 90 percent, in particular at least 95 percent, of the surface of the receiving area in a horizontal plane. The surface of the upper face of the insert plate, however, is less than 99 percent of this surface of the receiving area. By such a dimensioning, the insert plate is configured over virtually the entire surface area relative to the clear width of the receiving area between the lateral walls, and thus fills up this receiving area virtually entirely when viewed in the horizontal plane. On the other hand, however, a small gap, in particular of between 3 mm and 15 mm, in particular of between 3 mm and 10 mm, is permitted over the periphery so that, on the one hand, the relative movement of the insert plate may be carried out unhindered when setting the position or changing the position. In particular, as a result, this avoids direct contact and a side edge of the insert plate potentially scraping along the inner faces of the lateral walls. Thus, on the one hand, damage to the lateral walls is avoided and, on the other hand, damage to the insert plate and also to the lifting device is avoided. Last but not least, it is also advantageously achieved by this embodiment that liquid which is present on the upper face of the insert plate may be drained in a simple manner into the receiving area through this gap between the edge of the insert plate and the inner faces of the lateral walls.

Preferably, the basin has a drain, in particular on the base wall. As a result, a medium which is arranged in the basin and collects therein may drain out easily via the drain.

In particular, the basin is configured in one piece with the base wall and the lateral walls. In particular, the basin is configured from metal.

The base wall may be flat or slightly inclined or slightly bulged. In particular, it is provided that the point of the base wall at which an outlet for a drain of the sink is configured is offset furthest toward the bottom relative to the vertical position.

It may be provided that the upper face of the insert plate is configured to be entirely flat. However, the upper face may also be slightly bulged. It is also possible that the upper face of the insert plate is structured at least in some regions. As a result, a certain roughness may be generated. As a result, it is possible to avoid in an improved manner undesired slippage of objects positioned thereon. For example, this is advantageous when a change in the position of the insert plate occurs and objects are still arranged on the upper face of the insert plate. It is also possible that the upper face has specific positioning regions. These may be recesses. However, such recesses may be configured to be relatively small, for example. This is advantageous in order to be able to position, for example, vessels such as a glass or the like more securely. In particular, this is advantageous when a change in the position is tilting and/or rotating. An undesired slippage of such vessels is thus avoided. Moreover, it is also achieved by such predetermined positioning regions, for example, that when vessels are positioned on the upper face of the insert plate and, for example, are designed to be filled via the faucet, the water running out of the faucet flows accurately into the vessels in the case of a rotational movement and does not run over the circumference of the vessels onto the insert plate.

The lifting apparatus may be a feed chain or a spindle drive. The feed chain consists of specially shaped, high-precision and mechanical chain links. The chain links continuously interlock with one another in a positive manner. The particularity of the feed chain, in contrast to a "normal" chain is that it operates in both directions. It is able to pull and "push".

In the drive housing of the feed chain is located a pinion which engages in the intermediate links of the chain and moves the chain link by link—both forward and back. The chain itself has two loose ends. The load to be moved is secured at one end. The other end may be freely guided and is generally rolled up in a storage device. This saves installation space and is the main advantage of the feed chain.

Thrust force is introduced to the chain links via the drive element, generally an electric motor. Then the shoulders of the individual chain links press against one another and form a rigid unit. Thus the chain links may lift or push the load.

The positions and orientations provided when the sink is used as intended and arranged as intended are specified by the terms "top", "bottom", "front" "rear" "horizontal", "vertical", "depth direction", "width direction", "height direction".

Further features of the invention emerge from the claims, the figures and the description of the figures. The features and combinations of features mentioned above in the description, as well as the features and combinations of features mentioned below in the description of the figures and/or shown individually in the figures are not only able to be used in the respectively specified combination but also in other combinations or individually without departing from the scope of the invention. Thus embodiments of the invention which are not explicitly shown and described in the figures but which emerge from and which may be generated by separate combinations of features from the described embodiments are also to be regarded as encompassed and disclosed. Embodiments and combinations of features which thus do not have all of the features of an originally formulated independent claim are also to be regarded as disclosed.

BRIEF DESCRIPTION OF THE DRAWINGS

Exemplary embodiments of the invention are described hereinafter in more detail with reference to schematic drawings. In the drawings.

DETAILED DESCRIPTION OF EXEMPLARY EMBODIMENTS OF THE PRESENT INVENTION

Figure 1:
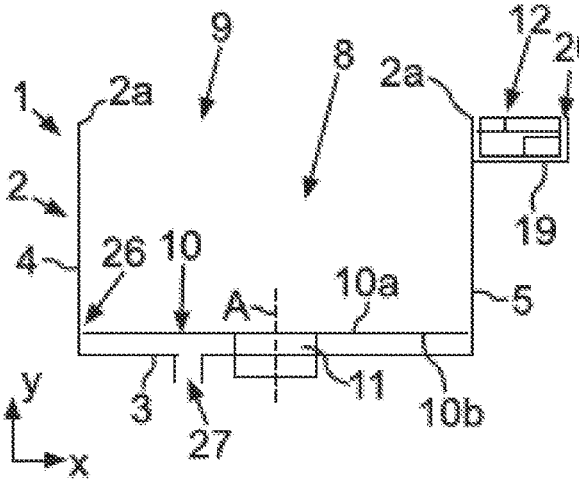
FIG. 1 shows a schematic sectional view through an exemplary embodiment of a sink according to the invention with an insert plate in a first position.

Elements which are the same or functionally the same are provided with the same reference characters in the figures.

Figure 3:
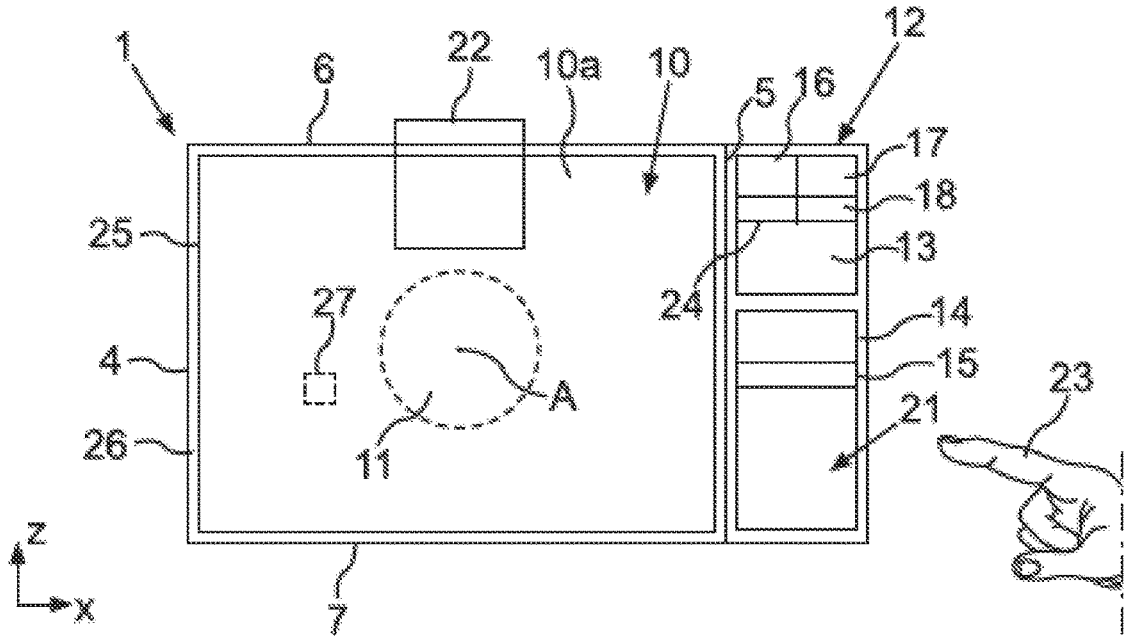
FIG. 3 shows a plan view of an exemplary embodiment of a sink.

A sink 1 is shown in FIG. 1 in a schematic vertical sectional view (x-y plane with the height direction y and width direction x). The sink 1 has a basin 2. The basin 2 has a base wall 3 and adjoining and upwardly extending lateral walls 4, 5, 6 (FIG. 3) and 7 (FIG. 3). The basin 2 is configured, in particular, in one piece. The basin is preferably configured from metal. The basin 2 has a receiving area 8. The receiving area 8 is delimited by the aforementioned walls 3 to 7. Thus the basin 2 has an upper loading opening 9. The sink 1 also has an insert unit. The insert unit is, in particular, an insert plate 10. The insert plate 10 is configured, in particular, in one piece. The insert plate 10 is a component of the sink 1 which is separate from the basin 2. The sink 1 also has a lifting device 11. The insert plate 10 is arranged on the lifting device 11. In particular, the insert plate is arranged on the lifting device 11 such that it can be released in a non-destructive manner. The insert plate 10 is movable relative to the basin 2 by the lifting device 11. In this context, a movement may take place in the height direction (y-direction) of the sink 1. Additionally or alternatively, a rotation may take place about a vertical axis A of the lifting device 11. Additionally or alternatively, a tilting of the insert plate 10 may take place. This means that the insert plate 10 may be set with its plane at an angle to a horizontal plane. It may thus be positioned in an inclined or oblique manner. In FIG. 1 the insert plate 10 is shown in an exemplary position in the receiving area 8. In particular, this is a position which has been moved downwardly. In this regard, the insert plate 10 is arranged directly adjacent to the base wall 3.

Preferably, the sink 1 has an interaction unit 12. The interaction unit 12 may have a display unit 13 (FIG. 3). The interaction unit 12 may have an operating device 14. The operating device 14 may have one or more operating elements. The operating elements may be push buttons or switches or toggle elements or rotary knobs. The operating device 14, however, may also additionally or alternatively have a touch-sensitive operating panel 15. In an advantageous embodiment it may be provided that the interaction unit 12 has at least one optical detection unit 16. The optical detection unit 16 may be, for example, a camera. The camera may be sensitive in the spectral range visible to humans. The interaction unit 12, however, may also additionally or alternatively have an acoustic unit 17. This acoustic unit 17 may be configured for the reception and/or for the output of speech signals. Moreover, the interaction unit 12 may have an identification unit 18. The identification unit 18 is configured for identifying, or for the identification of, a user of the sink 1. The identification unit 18 may also be formed, for example, by the optical detection unit 16. Additionally or alternatively, however, the identification unit 18 may also have, for example, the acoustic unit 17. As a result, for example, the user may be identified by the evaluation of a speech signal of a user. Additionally or alternatively, the identification unit 18 may be configured as a unit for detecting and evaluating a biometric feature of a user. For example, this may be a fingerprint sensor or a sensor for identifying an iris pattern.

Figure 2:
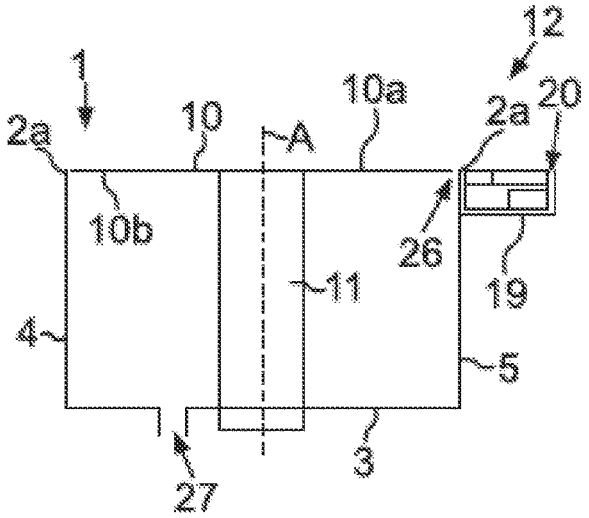
FIG. 2 shows the view of the sink according to FIG. 2 with the insert plate in a second position which is different from FIG. 1.

As may be identified in FIGS. 1 to 3, the interaction unit 12 may be configured at the side and directly adjacent to the basin 2. For example, a receiving housing 19 which is open at the top may be provided here. The receiving housing 19 may be configured separately from the basin 2. However, it may also be formed with the basin 2 such that it cannot be released in a non-destructive manner. In particular, the receiving housing 19 may also be configured in one piece with the basin 2. The lateral wall directly adjoining the receiving housing 19, in the example here the lateral wall 5, also forms a defining wall for the receiving volume 20 of the receiving housing 19.

Thus the receiving volume 20 is separated from the receiving area 8 of the basin.

In FIG. 2 the view according to FIG. 1 is shown, but the insert plate 10 is shown in a different position from FIG. 1. In FIG. 2 the insert plate 10 is oriented horizontally but moved upwardly. In particular, this position represents the maximum possible vertical position in normal mode. In particular, in this position an upper face 10*a* of the insert plate 10 is flush with an upper edge 2*a* of the basin 2. In particular, in this position the insert plate 10 forms a cover or a lid for the receiving area 8. This upper edge 2*a*, however, may also be for example an upper face of a mounting frame or a decorative frame which is a constituent part of the sink 1. The sink 1, in particular the basin 2, may be mounted with the mounting frame in a cutout of a worktop. The basin 2 may be covered from above with a decorative frame. A gap between the basin 2 and a defining wall in the worktop, which defines the cutout, thus may be covered from above. Such a decorative frame, in particular, represents an upper visible component of the arrangement.

In particular, the sink 1 also has a control unit 21 (FIG. 3). The lifting device 11 may be operated by the control unit 21. In particular, the interaction unit 12 may also be operated by the control unit 21.

The sink 1 may preferably also have a faucet 22, as may be identified in the simplified plan view in FIG. 3. The faucet 22 represents a functional unit of the sink 1. The interaction unit 12, in particular the operating device 14, may also be viewed as a functional unit of the sink 1. A further functional unit of the sink 1 may be the insert plate 10. A further functional unit of the sink 1 may be the lifting device 11.

The lifting device 11 preferably has a lifting unit and a motor. As a result, the lifting device may be changed in terms of its length or height in the direction of the vertical axis A. Moreover, the lifting device may be additionally or alternatively rotated about the vertical axis A. As a result, a rotational movement about this vertical axis A is also possible as a position, or as a change in the position, of the insert plate 10. Last but not least, the lifting device 11 may also be set such that the insert plate 10 may be set in an oblique or inclined manner relative to a horizontal plane.

An operating state of the sink 1 may be identified and/or a change in the operating state of the sink 1 may be identified and/or an operation of a user who operates the sink 1, in particular at least one functional unit of the sink 1, may be identified by the interaction unit 12. Depending on the identification by the interaction unit 12, the lifting device 11 is able to be operated for automatically changing the position of the insert plate 10. In FIG. 3 a schematic view of a finger 23 of a user is also shown. The interaction unit 12 is preferably configured for detecting a gesture of the user, in particular of the finger 23. In particular, the gesture is a contactless gesture. Additionally or alternatively, however, a direct operation of the operating device 14 may also be carried out with the finger 23. It is provided that an operating state and/or a change in the operating state may be detected by the camera 16 and/or the acoustic unit 17 and/or the operating device 14. An operating state may be, for example, a setting of the operating device 14 and/or a change in the operating state may be a change in the setting of the operating device 14.

A change in the position of the insert plate 10 may be dependent on the type and/or intensity and/or duration of an operating state of at least one functional unit of the sink 1 and/or a change in the position may be dependent on the type and/or intensity and/or duration of a change in the operating state of at least one such functional unit of the sink 1.

The interaction unit 12 has a normal mode. The actual operation of the sink 1 is also detected in this normal mode. Moreover, the interaction unit 12 has a defining mode which is different from the normal mode. This defining mode may be set, for example, by a user. In this defining mode it is possible that at least one user defines or predetermines at least one reference position of the insert plate 10. In particular, in this defining mode such a reference position may be linked with a specific operating state of at least one functional unit of the sink 1 and/or with a defined change in the operating state of at least one functional unit of the sink 1. At least one such reference position may be stored as a user profile in a memory unit 24 of the interaction unit 12.

In an advantageous embodiment it is provided that the surface shown in FIG. 3 (depth direction z and width direction x) of the upper face 10*a* is at least 80 percent, in particular at least 90 percent, in particular at least 95 percent, of the surface of the receiving area 8 which is viewed in a horizontal plane (in FIG. 3 the plane of the figures). In particular, however, this surface of the upper face 10*a* is less than 99 percent of this surface of the receiving area 8 in the aforementioned horizontal plane. As a result, it is achieved that a peripheral edge 25 of the insert plate 10 is spaced apart from the lateral walls 4, 5, 6 and 7. In particular, a peripheral gap 26 between the insert plate 10 and the lateral walls 4 to 7 is formed thereby. The gap 26 may be between 3 mm and 15 mm. Preferably, this gap 26 is sufficiently small, at least in the horizontal position of the insert plate 10, that objects such as cutlery or the like are not able to slip through. Moreover, it is thus possible to avoid the situation where a finger 23 is trapped in this horizontal position of the insert plate 10.

As is also shown in FIGS. 1 to 3, the sink 1 has an outlet opening 27, for example a drain. This outlet opening is configured, in particular, in the base wall 3. Media may drain out of the receiving area 8 from the basin 2 through this outlet opening 27.

Figure 4:
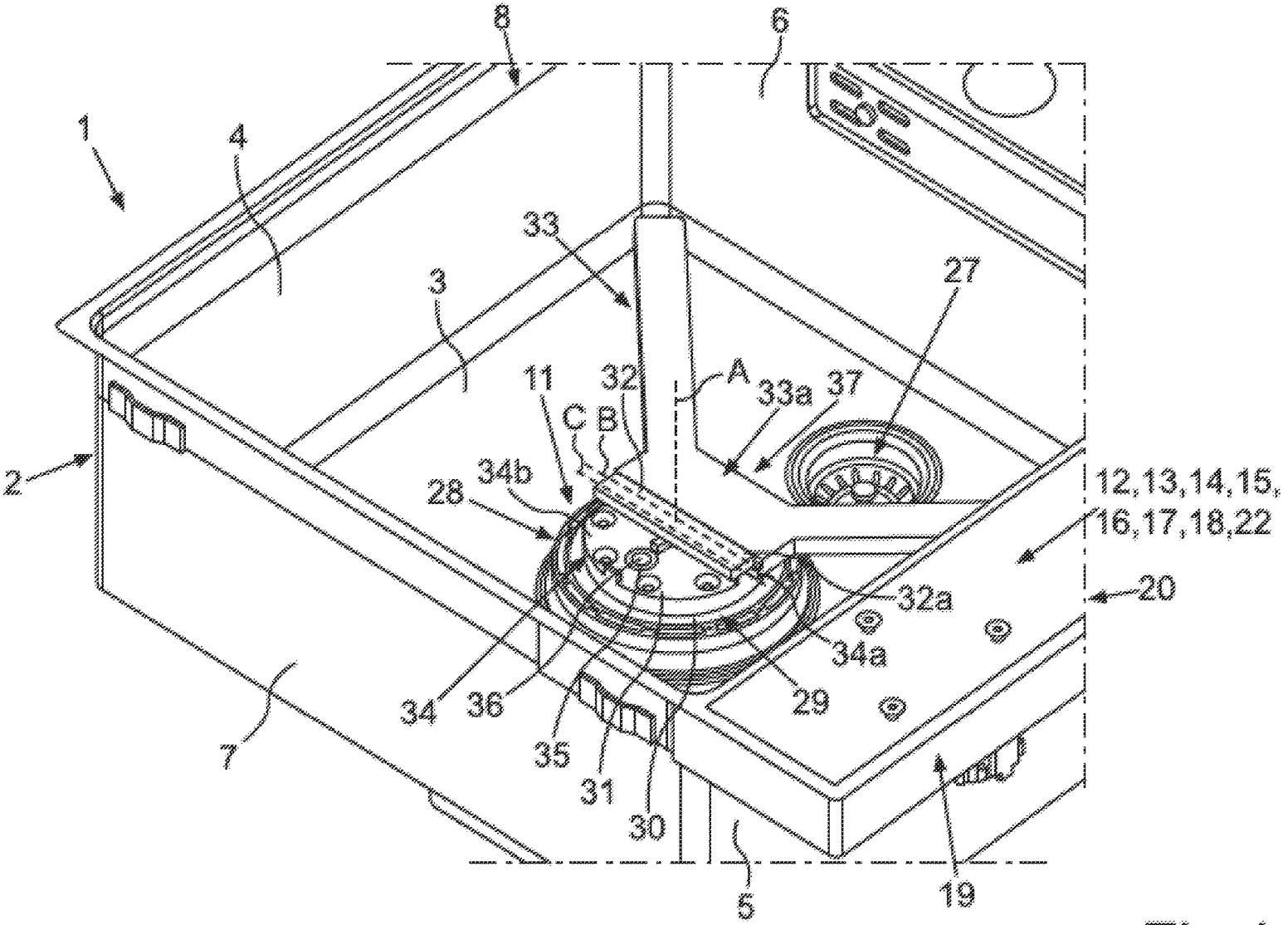
FIG. 4 shows a perspective partial view of an exemplary embodiment of a sink with an exemplary embodiment of support vanes of a lifting device.

An exemplary embodiment of a sink 1 is shown in FIG. 4 in a perspective view. The lifting device 11 is shown. The lifting device 11 has a lifting unit 28. This lifting unit is secured, in particular, centrally in the middle of the base wall 3. The lifting unit 28 may be moved in the direction of the axis A. In this context, the lifting unit 28 has a plurality of lifting segments. The lifting unit 28 is shown in the fully moved-together state in FIG. 4. This means that it is retracted to a maximum extent downwardly into the receiving area 8. Preferably, this lifting unit 28 has an upper lifting segment. The upper lifting segment is formed, in particular, by an upper housing segment 29 of a housing 40 of the lifting unit 28. A plate receiver 31 is arranged in an upper region 30 of this upper lifting segment. The plate receiver 31 in this case is a flat cylindrical disk. This plate receiver 31 has a central projection 32. A first support vane 33 is arranged on this central projection 32. In particular, the support vane 33 is mounted on the central projection 32 so as to be pivotable about a horizontal axis B. The one-piece support vane 33 is positioned from above on the plate receiver 31. An upper face 34 of this plate receiver 31 has upper face regions 34*a* and 34*b*. These upper face regions are offset downwardly relative to the central projection 32. The support vane 33 is positioned on this upper face region 34*a*. For the sake of improved clarity, however, a second support vane, not shown, which is separate from the first support vane 33 but in particular has the same size and the same shape, is arranged thereon. This second support vane is mounted on the central projection 32 so as to be pivotable about a further horizontal axis C. The horizontal axes B and C are oriented parallel to one another. The second support vane is positioned from above on the second upper face region 34*b*. In the horizontal basic position, an upper face 33*a* of the support vane 33 is flush with an upper face 32*a* of the central projection 32. This is correspondingly configured with an upper face of the second support vane.

The support vane 33 and the second support vane, not shown, are arranged spaced apart from one another by the central projection 32. They may be pivoted independently of one another about their axes B and C. Thus individual tilted positions of a support vane 33 may also be set relative to the horizontal plane. In particular, the plate receiver 31 also has a through-passage 35. An actuating element may extend from below through the plate receiver 31 through this through-passage and thus in this case come into contact with the second support vane from below and lift it up, so that it is pivoted about its horizontal axis C. Correspondingly, a further through-passage which is below the first support vane 33 is configured on the side opposing the through-passage 35. This may also be correspondingly lifted, as has been described above. Preferably, it is provided that the through-passage 35 is covered from above by an elastic cover 36. The elastic cover 36 permits the actuating element to be able to protrude through the through-passage 35 and to be able to be positioned further up relative to the upper face region 34*b*, and a corresponding protruding of the actuating element may result due to the elastic deformation of the elastic cover 36. As a result, therefore, the corresponding second support vane may also be lifted.

The plate receiver 31 is configured with the cover 36 as a two-component injection-molded component.

Figure 5:
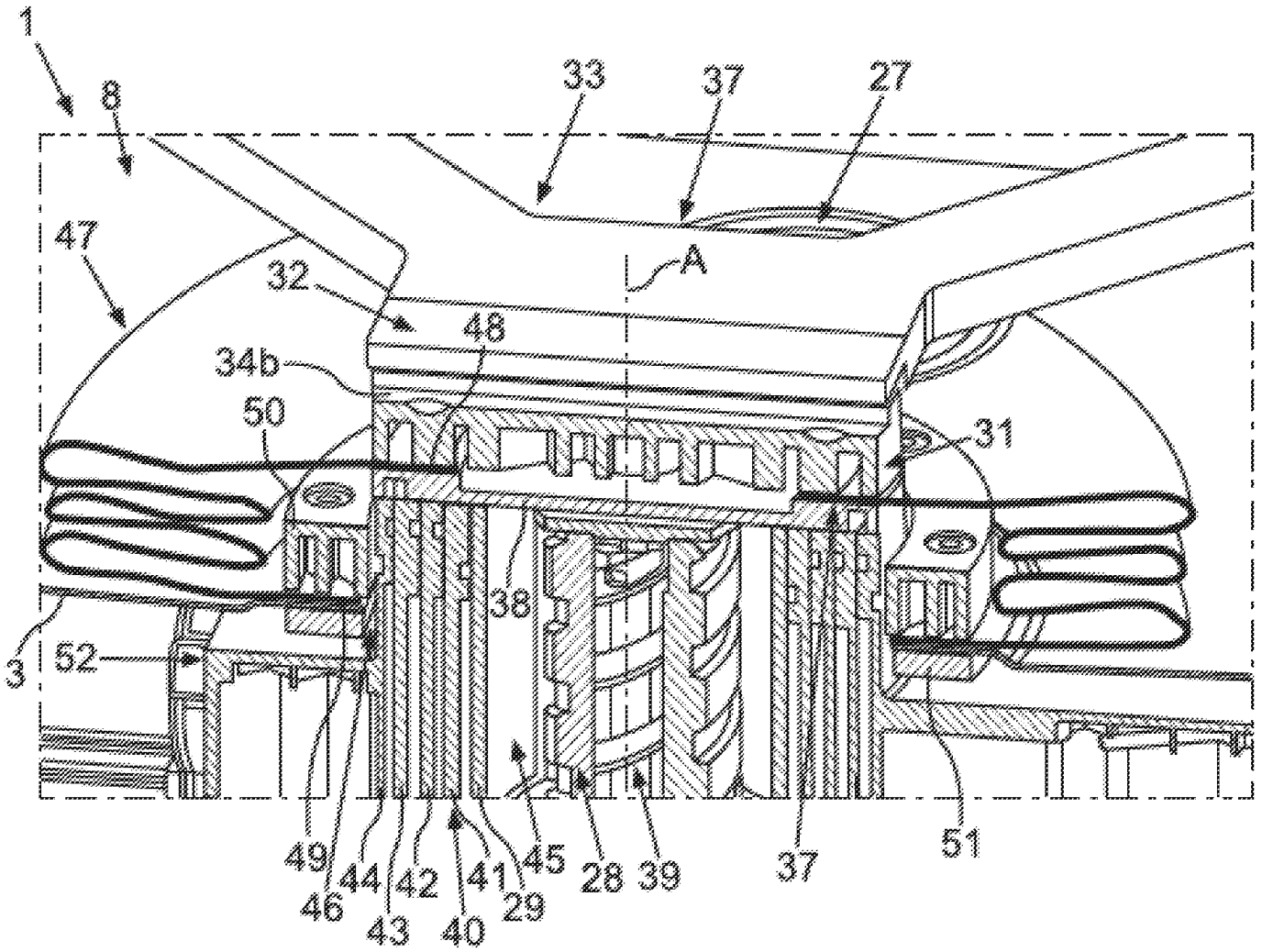
FIG. 5 shows a perspective sectional view of a partial region of the arrangement in FIG. 4 with a sealing sleeve around a lifting unit of the lifting device.

A partial region of the arrangement in FIG. 4 is shown in FIG. 5 in a perspective sectional view.

It may be identified that the plate receiver 31, which is configured as a flat cylinder, is positioned from above on an upper face 37 of the upper lifting segment of the lifting unit 28. This upper face 37 is, in particular, an upper face of an upper cover plate 38.

The lifting unit 28 has a lifting apparatus 39. The lifting apparatus 39 may be a spindle drive. However, it may also be a feed chain, for example. The lifting unit 28 also has a housing 40. The housing 40 surrounds this lifting apparatus 39 over the periphery. The housing 40 is, in particular, a telescopic housing. This means that it has a plurality of housing segments. In the exemplary embodiment, these lifting segments are configured as hollow cylinders. In the exemplary embodiment an upper housing segment 29 is configured in an extended state, a second housing segment 41 following downwardly, a further housing segment 42 following downwardly, a further housing segment 43 following downwardly and then a lower housing segment 44. The fully retracted position of the lifting unit 28 is shown in FIG. 5. The lifting unit 28 is thus moved entirely downward. In this state, the housing 40 is fully telescoped and in a vertically minimized position. The housing segments 29 and 41 to 44 are thus fully telescoped as shown in FIG. 5. If the lifting unit 28 is extended out of this downwardly moved state in which the insert plate 10 is also arranged in the lowered position, and thus moved upwardly, the housing segments 29 and 41 to 44 are pulled apart. The lifting apparatus 39 is arranged in an interior 45 of this housing 40. The lifting unit 28 extends through a through-passage or leadthrough 46 in the base wall 3. The lifting unit 28 is thus arranged on both sides of this base wall 3.

Moreover, the lifting device 11 has a sealing sleeve 47. The sealing sleeve 47 is a separate component from the housing 40. The sealing sleeve 47 surrounds that partial region which extends over the periphery in the receiving area 8 of the lifting unit 28. The sealing sleeve 47 is elastically configured. The sealing sleeve may be configured in one piece. The sealing sleeve may be configured, for example, as a folding bellows. However, other specifications are also possible in terms of material and geometry.

In FIG. 5 the sealing sleeve 47 is configured as a folding bellows. In FIG. 5 the sealing sleeve is shown in the fully compressed or folded-up state. The sealing sleeve 47 has an upper edge 48. In the exemplary embodiment shown, the upper edge 48 is clamped between the plate receiver 31 and the cover 38. In particular, this upper edge 48 is also sealingly arranged between the plate receiver 31 and the cover 38. The cover 38 may also be denoted as a lifting plate.

Moreover, this sealing sleeve 47 has a lower end 49. This lower end 49 is positioned directly on the inner face of the base wall 3. Moreover, it is provided that the sink 1 has an adapter 50. This adapter 50 is preferably a separate component. The adapter 50 is preferably designed as a circumferential adapter ring which is configured without interruption. The adapter 50 is positioned from above on this lower edge 49 of the sealing sleeve 47. As may be identified, the lower edge 49 is clamped between this adapter 50 and the base wall 3. In particular, a sealed clamping is also configured here.

In particular, the adapter 50 is secured to the base wall 3 such that it can be released in a non-destructive manner, in particular screwed by screw connections. To this end, for example, a counter bearing 51 may be arranged below the base wall 3. This counter bearing 51 may be a bearing ring. At the same time, the counter bearing 51 may be configured as an acoustic damping unit.

As may be identified in FIG. 5 the lifting device 11 extends on both sides of the base wall 3. The lifting device extends through the opening or leadthrough 46.

In particular, the lifting device 11 has only a single lifting unit 28. In particular, only a single lifting apparatus 39 of the lifting unit 28 is provided. This lifting apparatus 39 may be, for example, a spindle drive or a feed chain. It may, however, also be a hydraulic or pneumatic lifting cylinder.

The lifting unit 28 is longitudinally adjustable in the direction of the longitudinal axis A and thus in the height direction. The lifting unit 28 is arranged centrally on the base wall 3.

In an advantageous embodiment, the element 51 is also configured as a damper unit. As a result, the lifting device 11 is acoustically decoupled from the base wall 3. The damper unit may be a rubber damper or an acoustic foam. This damper unit is directly arranged on the lower face of the base wall 3. It may be provided that the damper unit 51 is connected to a receiving housing 52 of the lifting device 11. This receiving housing 52 is arranged below the base wall 3. it may be provided that this receiving housing 52 is arranged entirely below the base wall 3 and thus entirely outside the receiving area 8. It may also be provided that the lowermost housing segment 44 of the housing 40 of the lifting unit 28 is configured in one piece in the receiving housing 52. In such an embodiment, therefore, only this housing segment 44 is able to extend through the leadthrough 46 and is able to be arranged on both sides of the leadthrough 46.

Figure 6:
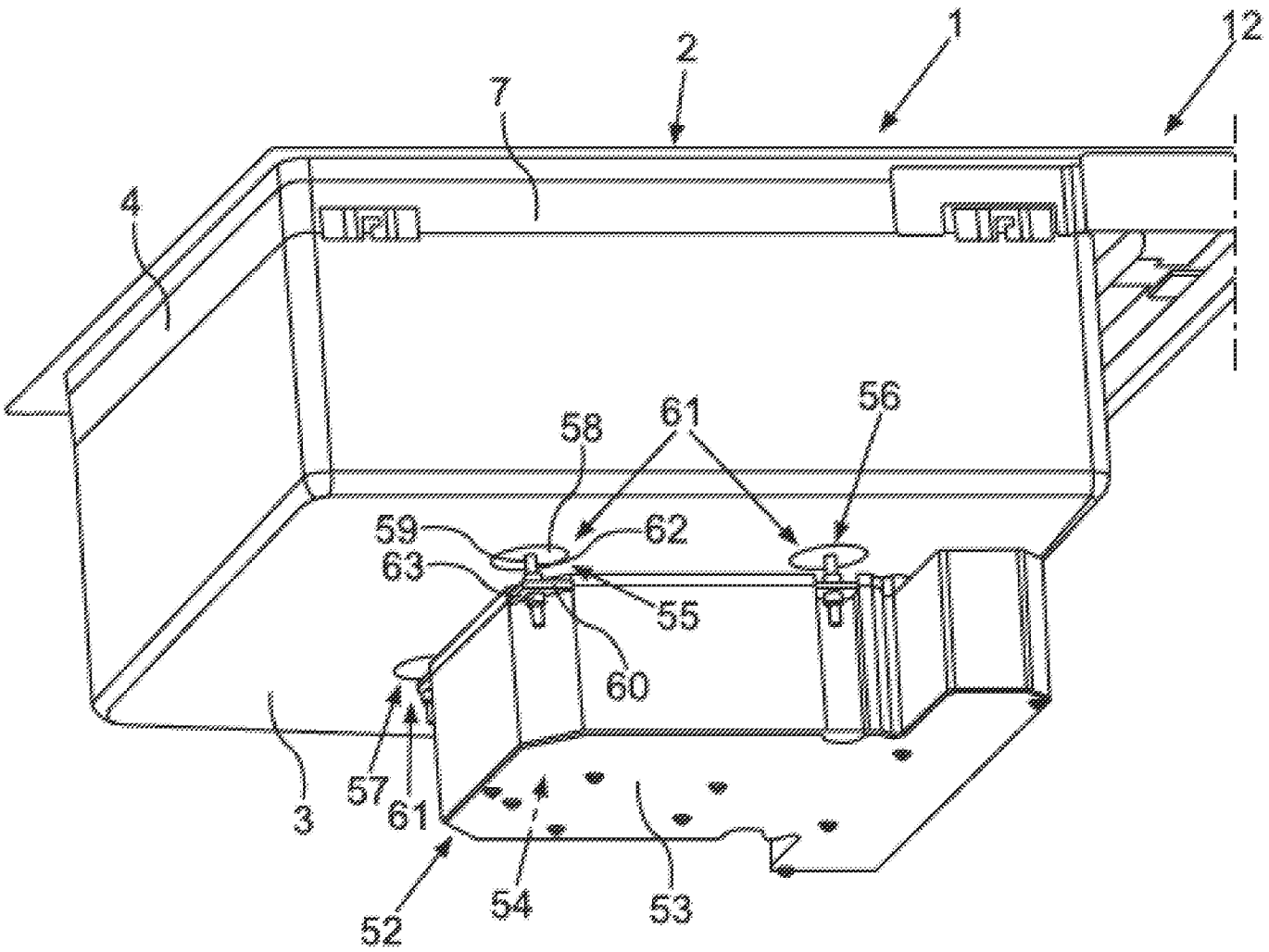
FIG. 6 shows a perspective view of an exemplary embodiment of the sink with a receiving housing on the lower face of the base wall of the basin.

The sink 1 is shown in FIG. 6 in a perspective view. It may be identified that the receiving housing 52 is arranged below the base wall 3. In a projected view, the receiving housing is arranged in the direction of the axis A in terms of surface area within the surface of the base wall 3, in particular entirely within this surface of the base wall 3. The receiving housing 52 is closed from below by a cover 53. The cover 53 may be removed. As a result, it is possible to reach the interior of the receiving housing 52. A motor 54 is arranged in this receiving housing 52. The motor 54 is a constituent part of the lifting unit 28. The motor 54 is thus entirely arranged outside the receiving area 8. The lifting apparatus 39 is driven by the motor 54 so that this lifting apparatus is longitudinally adjusted in the direction of the longitudinal axis A.

Preferably, the receiving housing 52, which is a separate component from the base wall 3 and thus also separate from the basin 2, is held on at least one, in particular a plurality of, securing elements 55, 56, 57 and a further additional securing element, not shown, on the lower face of the base wall 3. The securing elements 55 to 57 are secured to this lower face, which represents the outer face, of the base wall 3 such that they cannot be released in a non-destructive manner. In particular, the securing elements 55 to 57 are welded or adhesively bonded to this lower face.

Preferably, a securing element 55 to 57 has a base 58. This base 58 is configured, in particular, in a plate-like manner. The securing element 55 is directly secured to the lower face 3 with this base 58. Moreover, the securing element 55 has a coupling pin 59 in addition to the base 58. This coupling pin is configured for direct coupling to the receiving housing 52. Preferably, to this end the receiving housing 52 has a flange 60. A hole is located in this flange 60. The coupling pin 59 may be guided through this hole. Thus a mechanical connection may be achieved between the securing element 55 and the receiving housing 52. The other securing elements 56 and 57 are also correspondingly configured.

Preferably, the securing device 61 is a multi-point bearing, by means of which the receiving housing 52 is secured to the basin 2, in particular to the base wall 3. This multi-point bearing is formed by the securing elements 55, 56 and 57. In particular, the multi-point bearing is a four-point bearing. This is preferably formed by the four securing elements 55 to 57 in this case.

In an advantageous embodiment, a coupling pin 59 is additionally configured as a vertical level regulation element. The level of the receiving housing 52 in the height direction of the sink 1 may be set in a defined manner by this level regulation element. In particular, therefore, a horizontal position of the receiving housing 52 is able to be regulated in terms of the level thereof. In an advantageous embodiment, the coupling pin 59 has a thread 62 for this level regulation. A screw nut 63 may be screwed on by this thread 62. Therefore, the vertical position of the receiving housing 52 in the height direction may be regulated in terms of the level thereof by the screwed position of this screw nut 63. Particularly advantageously, this is made possible by the four-point bearing in which, in particular, all four securing elements 55 to 57 with their respective coupling pins 59 are configured as level regulation elements.

Preferably, an irreversible mounting and dismantling of the receiving housing 52 is also made possible by this connection of the receiving housing 52 to the basin 2 which can be released in a non-destructive manner.

A dismantling mode which is different from the normal mode of the lifting unit 28 may also be set. In this dismantling mode, the lifting unit 28 is set in a position located even higher in the height direction above the maximum lifted position of the lifting unit 28 in normal mode and thus also the corresponding position of the insert plate 10. In the maximum lifted position in normal mode it is provided, in particular, that the upper face 10*a* of the insert plate 10 is flush with the upper face of the upper edge 2*a* of the basin 2 or a decorative frame or a mounting frame. In the dismantling position which is higher relative thereto, the insert plate 10 is preferably positioned such that it is arranged with its lower face 10*b* higher than this upper edge 2*a* with a vertical spacing. In particular, this vertical spacing is at least 2 cm, in particular at least 3 cm. As a result, the insert plate 10 may be gripped on its edge 25 by a hand and securely held for removing from the lifting unit 28. The dismantling position is, in particular, a horizontal position of the insert plate 10. The lower face 10*b* of the insert plate 10 is thus positioned entirely above the upper edge 2*a*.

LIST OF REFERENCE CHARACTERS

1 Sink
2 Basin
2*a* Upper edge
3 Base wall
4 Side wall
5 Side wall
6 Side wall
7 Side wall
8 Receiving area
9 Loading opening
10 Insert plate
10*a* Upper face
10*b* Lower face
11 Lifting device
12 Interaction unit
13 Display unit
14 Operating device
15 Operating panel
16 Optical detection unit
17 Acoustic unit
18 Identification unit
19 Receiving housing
20 Receiving volume
21 Control unit
22 Faucet
23 Finger
24 Memory unit
25 Edge
26 Gap
27 Outlet opening
28 Lifting unit
29 Upper lifting segment
30 Upper region
31 Plate receiver
32 Central projection
32*a* Upper face
33 First support vane
33*a* Upper face
34 Upper face
34*a* Upper face region
34*b* Upper face region
35 Through-passage
36 Cover
37 Upper face
38 Cover plate
39 Lifting apparatus
40 Housing
41 Housing segment
42 Housing segment
43 Housing segment
44 Housing segment
45 Interior
46 Leadthrough
47 Sealing sleeve
47*a* Outer face
48 Upper edge
49 Lower end
50 Adapter
51 Counter bearing
52 Receiving housing
53 Cover
54 Motor
55 Securing element
56 Securing element
57 Securing element
58 Base
59 Coupling pin
60 Flange
61 Securing device
62 Thread
63 Screw nut

The invention claimed is:

1. A sink, comprising:

a basin including a base wall and lateral walls adjoining the base wall, said basin including a receiving area delimited by the base wall and the lateral walls;

an insert plate separate from the basin and inserted into the receiving area;

a lifting device configured to move the insert plate relative to the basin, said lifting device extending into the base wall through an opening such that the lifting device is arranged on both sides of the base wall; and a securing device configured to secure the lifting device to the base wall, wherein the securing device includes a multi-point bearing.

2. The sink of claim 1, wherein the lifting device includes a lifting unit which is longitudinally adjustable in a height direction of the sink and which is arranged centrally on the base wall.

3. The sink of claim 1, wherein the lifting device includes a separate damper unit to acoustically decouple the lifting device from the base wall.

4. The sink of claim 3, wherein the damper unit is a rubber damper or an acoustic foam.

5. The sink of claim 3, wherein the lifting device includes a receiving housing arranged below the base wall, said damper unit bearing directly against a lower face of the base wall and connected to the receiving housing of the lifting device.

6. The sink of claim 5, wherein the securing device includes a plurality of securing elements to secure the receiving housing of the lifting device to the lower face of the base wall.

7. The sink of claim 6, wherein at least one of the securing elements includes a base which is adhesively bonded or welded to the lower face of the base wall.

8. The sink of claim 6, wherein at least one of the securing elements includes a coupling pin, said receiving housing being suspended on the coupling pin.

9. The sink of claim 8, wherein the coupling pin is configured as a vertical level regulation element to set a level of the receiving housing in a defined manner in a height direction of the sink.

10. The sink of claim 9, wherein the coupling pin includes a thread for regulating the level of the receiving housing.

11. The sink of claim 1, wherein the lifting device includes a lifting unit which is longitudinally adjustable in a height direction of the sink, said lifting unit including a housing and a lifting apparatus which is arranged in the housing, said lifting unit configured to extend through the opening in the base wall of the basin.

12. The sink of claim 11, wherein the housing of the lifting unit includes a plurality of housing segments which are movable relative to one another in the height direction of the sink and which form a telescopic housing.

13. The sink of claim 12, wherein the housing segments are dimensionally rigid.

14. The sink of claim 1, wherein the multi-point bearing is embodied as a four-point bearing.

15. The sink of claim 1, wherein the lifting device includes a receiving housing arranged below the base wall, and a motor arranged in the receiving housing for driving a lifting unit of the lifting device.

16. The sink of claim 1, wherein the insert plate includes an upper face having a surface which is at least 80% of a surface of the receiving area in a horizontal plane, but less than 99% of the surface of the receiving area.

17. The sink of claim 1, wherein the insert plate includes an upper face having a surface which is at least 90% of a surface of the receiving area in a horizontal plane, but less than 99% of the surface of the receiving area.

18. The sink of claim 1, wherein the insert plate includes an upper face having a surface which is at least 95% of a surface of the receiving area in a horizontal plane, but less than 99% of the surface of the receiving area.

* * * * *